US010718106B2

(12) United States Patent
Moscovits et al.

(10) Patent No.: US 10,718,106 B2
(45) Date of Patent: Jul. 21, 2020

(54) TOILET ANTI-SPLASH DEVICE

(71) Applicant: Moskovits Inventions LTD., Yavne (IL)

(72) Inventors: Shahar Moscovits, Yavne (IL); Doron Moskovich, Yavne (IL)

(73) Assignee: MOSKOVITS INVENTIONS LTD, Yavne (IL)

( * ) Notice: Subject to any disclaimer, the term of this patent is extended or adjusted under 35 U.S.C. 154(b) by 0 days.

(21) Appl. No.: 16/349,901

(22) PCT Filed: Dec. 14, 2017

(86) PCT No.: PCT/IL2017/051349
§ 371 (c)(1),
(2) Date: May 14, 2019

(87) PCT Pub. No.: WO2018/109768
PCT Pub. Date: Jun. 21, 2018

(65) Prior Publication Data

US 2020/0063420 A1 Feb. 27, 2020

(30) Foreign Application Priority Data

Dec. 16, 2016 (IL) ..... 249611

(51) Int. Cl.
*E03D 9/00* (2006.01)
*A47K 17/00* (2006.01)

(52) U.S. Cl.
CPC ..... *E03D 9/00* (2013.01); *A47K 17/00* (2013.01)

(58) Field of Classification Search
CPC ..... E03D 9/00
USPC ..... 4/300.3
See application file for complete search history.

(56) References Cited

U.S. PATENT DOCUMENTS 4,866,793 A 9/1989 Luedtke et al.
5,313,672 A 5/1994 Luedtke et al.

FOREIGN PATENT DOCUMENTS

DE 19832716 A1 1/2000

OTHER PUBLICATIONS

IPER—International Preliminary Examination Report and Amendments.

*Primary Examiner* — Lori L Baker
(74) *Attorney, Agent, or Firm* — Blue Filament Law PLLC

(57) ABSTRACT

A toilet anti-splash device is provided that includes a first section with a dispersing region configured with spaced deflectors for dispersing and deflecting urine flow, a second section coupled with said first section by which a disinfectant stream is generated in response to a toilet-based water flushing operation and is directed to all of the deflectors, and a hanger by which said anti-splash device is suspended from a toilet rim into an interior of a toilet bowl.

15 Claims, 13 Drawing Sheets

TOILET ANTI-SPLASH DEVICE

FIELD OF THE INVENTION

The present invention relates to the field of sanitation devices. More particularly, the invention relates to a toilet anti-splash device.

BACKGROUND OF THE INVENTION

Splash back from a toilet bowl wall during male urination is unfortunately a widespread problem that leads to soiling of bathroom surfaces and of clothing and to the emission of unpleasant odors.

Some toilet anti-splash devices are known from the prior art, such as US 2015/0143624 which discloses a sealed pouch containing a plurality of spherical beads within which a urine stream is received and from which splash back is reduced by its outer mesh surface, and a flexible tether coupled to the pouch and reversibly attached to an outer surface of a toilet bowl. However, the beads tend to gravitate within the pouch, and therefore provide a non-uniform deflecting capability within the pouch. Users are unaware of this non-uniform deflecting capability and consequently suffer from splash back. When the beads are made from water soluble materials, they tend to dissolve quickly when contacted by a urine stream and the flow of the toilet flushing may cause them to stick to each another and become a single solid piece. Also, they will have to be frequently replenished, resulting in unnecessary user aggravation and expense.

It is an object of the present invention to provide a toilet anti-splash device that reliably provides a uniform deflecting capability.

It is an additional object of the present invention to provide a toilet anti-splash device whose deflectors are entirely exposed to a cleaning fluid and will therefore not become discolored or scented.

It is an additional object of the present invention to provide a toilet anti-splash device that minimizes the rate of dissolution of a hygienic product that generates the cleaning fluid.

Other objects and advantages of the invention will become apparent as the description proceeds.

SUMMARY OF THE INVENTION

The present invention provides a toilet anti-splash device, comprising a first section comprising a dispersing region configured with a plurality of spaced deflectors for dispersing and deflecting urine flow, a second section coupled with said first section by which a disinfectant stream is generated in response to a toilet-based water flushing operation and is directed to all of said plurality of deflectors, and a hanger by which said anti-splash device is suspended from a toilet rim into an interior of a toilet bowl.

In one aspect, the first section is forwardly positioned with respect to the second section and is configured with an upper chamber having an upper opening through which the flushing water is introducible and at least one lower opening smaller than said upper opening through which the generated disinfectant stream is discharged and directed to all of the plurality of deflectors, to thereby ensure that all deflectors are entirely exposed to a cleaning fluid. The plurality of deflectors may be configured by a plurality of vertically and laterally spaced rods protruding forwardly from a substantially vertically oriented deflector-holding surface.

In one aspect, an upper surface of the second section is positioned rearwardly with respect to, and in abutting relation with, an entire rear portion of the first section delimiting the upper opening.

In one aspect, the second section comprises a retaining chamber in fluid communication with the upper chamber of the first section, for retaining therewithin a solid hygienic product by which the disinfectant stream is generated upon being contacted by the flushing water. The retaining chamber of the second section has an upper guiding surface extending forwardly from a rear, substantially vertically oriented surface of the second section to an intermediate region of the upper opening and which is located below the upper surface of the second section, said upper guiding surface adapted to guide at least a portion of the flushing water introduced through the upper opening towards the solid hygienic product.

In one aspect, the upper chamber of the first section is provided with a substantially horizontal restrictor-holding surface located forwardly to an upper surface of the deflector-holding surface, a plurality of flow restriction elements extending upwardly from said restrictor-holding surface are configured to restrict flow of the generated disinfectant stream and to thereby ensure that the plurality of deflectors will be cleaned with an improved cleaning action. The restrictor-holding surface is formed with the at least one lower opening and the plurality of flow restriction elements are positioned on the restrictor-holding surface rearwardly from the at least one lower opening.

In one aspect, the second section further comprises an additional retaining chamber for retaining therewithin an additional solid hygienic product for generating an additional disinfectant stream flowing directly to the interior of the toilet bowl via a discharge aperture formed in a rear surface of the second section.

In one aspect, a rear face of the deflector-holding surface of the first section is concave and a rear face of the rear surface of the second section is convex to accommodate positioning of the additional solid hygienic product.

In one aspect, an elongated rear opening through which is introducible residual flushing water for use by the additional retaining chamber is formed in a central region of the rear surface of the second section, such that an upper edge of said rear opening coincides with, or is located below, a bottom surface of the retaining chamber in fluid communication with the upper chamber of the first section. An elongated abutment adapted to contact the toilet bowl may extend rearwardly from the rear surface and below the rear opening, wherein said abutment is fixed obliquely to the rear surface and extends upwardly into a projected area of the rear opening, to guide the residual flushing water into the additional retaining chamber.

In one aspect, the second section further comprises a flow restricting region positioned on the rear surface below the additional retaining chamber, said flow restricting region adapted to restrict flow of the additional disinfectant stream from the additional retaining chamber to the discharge aperture and to thereby prevent blockage of the discharge aperture.

DETAILED DESCRIPTION OF PREFERRED EMBODIMENTS

The anti-splash device of the present invention comprises two sections—a first section comprising a dispersing region for dispersing and deflecting urine flow to thereby decrease the kinetic energy of the splash back, and a second section for controlling the flow of a disinfectant stream so as to be directed to the entire dispersing region in response to a toilet-based water flushing operation (to thereby ensure that all deflectors are entirely exposed to a cleaning fluid), while minimizing the rate of dissolution of a hygienic product that generates the cleaning fluid that is directed to the dispersing region.

Figure 1:
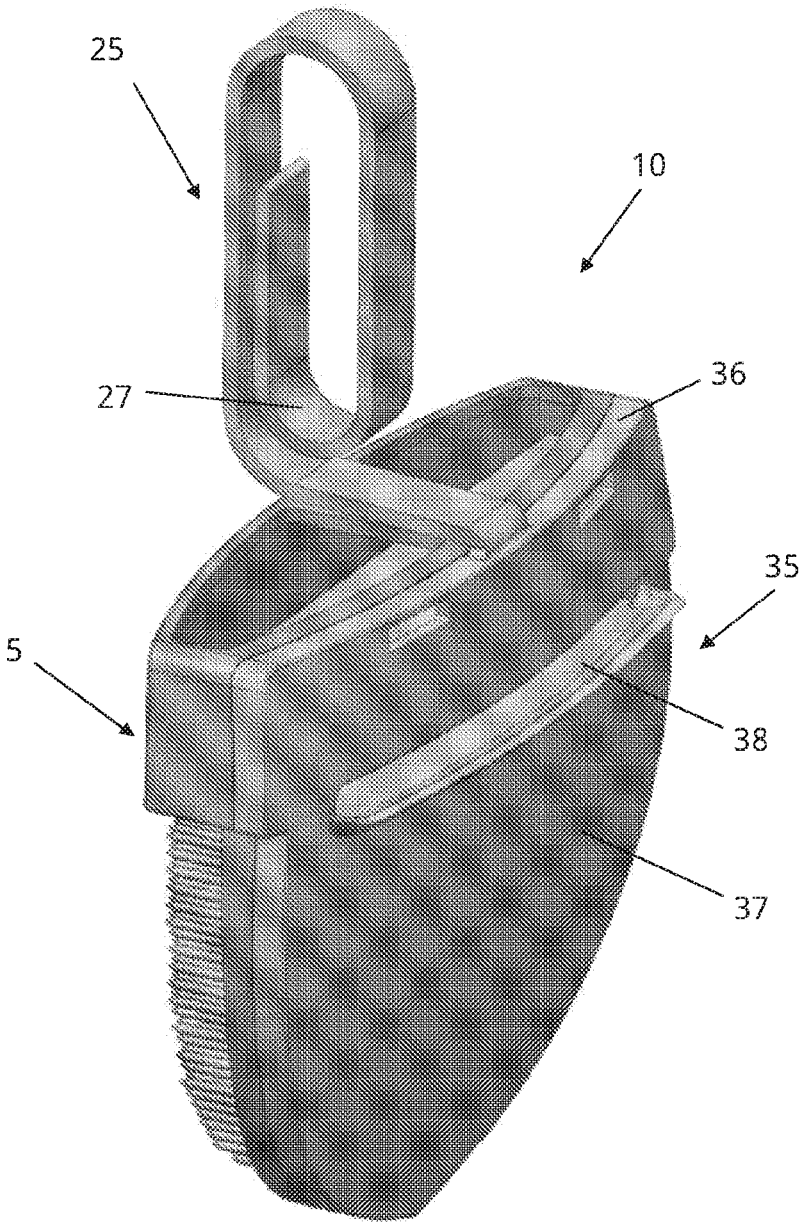
FIG. 1 is a perspective view from the top and rear of an anti-splash device according to one embodiment of the present invention.

FIG. 1 illustrates an anti-splash device according to one embodiment of the present invention, which is generally indicated by numeral 10.

Anti-splash device 10 comprises a forward or user-facing deflecting section 5, a rear disinfecting section 35 coupled to deflecting section 5, e.g. releasably coupled thereto, and a hanger 25 connected to the upper surface 36 of disinfecting section 35 and having a hook portion 27 adapted to be suspended from the rim of a toilet bowl. An elongated abutment 38, which may be curved, for contacting the toilet bowl rim when anti-splash device 10 is suspended therefrom extends rearwardly from the rear surface 37 of disinfecting section 35.

As referred herein, the relative directional terms such as "forwardly", "rearwardly", "upper", "lower" and "side" describe the relative position of elements when anti-splash device 10 is suspended from a toilet rim.

Figure 2:
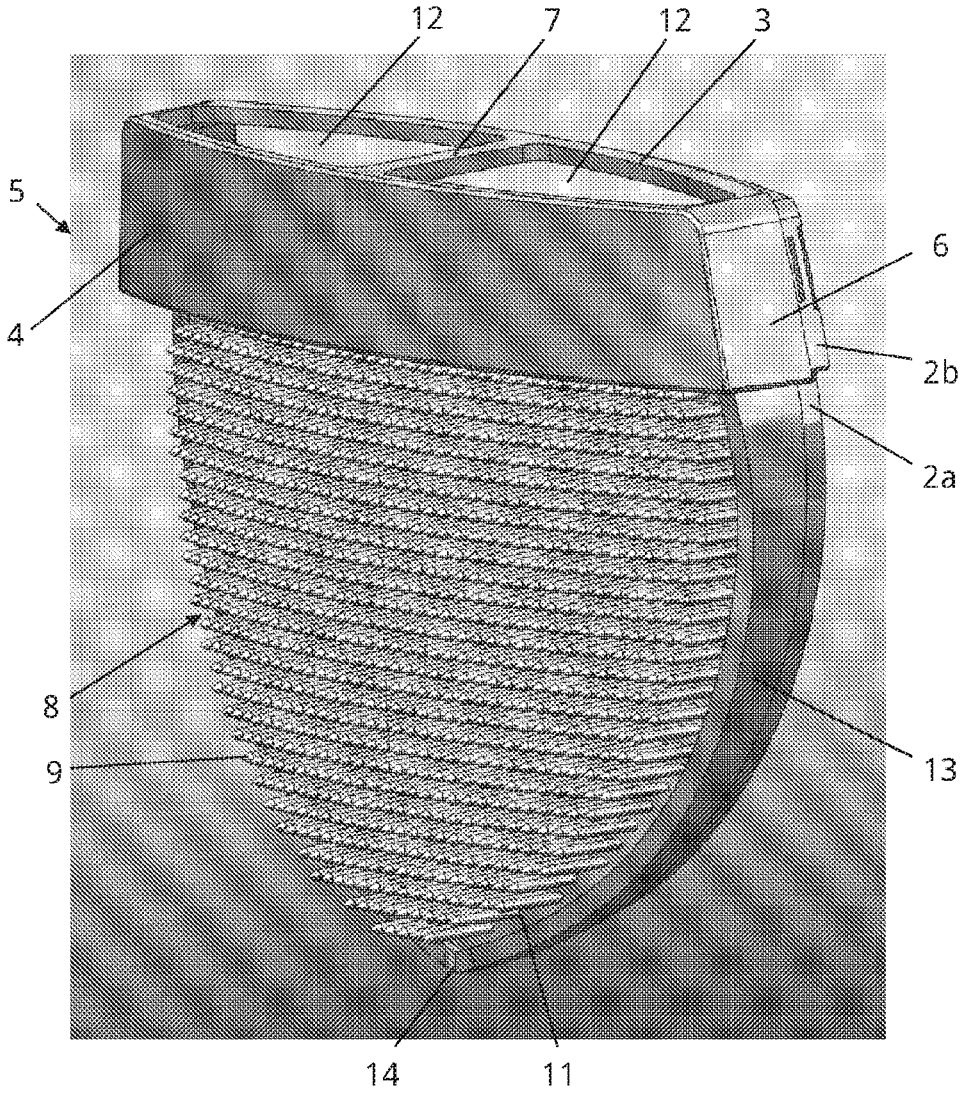
FIG. 2 is a perspective view from the front of a deflecting section used in conjunction with the anti-splash device of FIG. 1, when separated from the disinfecting section.

FIG. 2 illustrates deflecting section 5 when separated from the disinfecting section. Dispersing region 8, which is preferably urine-resistant, is configured by a plurality of mutually parallel and evenly vertically and laterally spaced short-dimensioned rods 9, for example having a length of 5-15 mm, protruding forwardly from substantially vertically oriented deflector-holding surface 11, whose rear face may be concave. A urine flow is allowed to pass through the spacing between adjacent rods 9 and to impinge upon surface 11. The possibility of splashing is significantly reduced as the kinetic energy of the urine flow is decreased after being dispersed and deflected by a plurality of rods 9.

It will be appreciated that the invention is also applicable to a dispersing region having unevenly spaced rods, rods that are not mutually parallel, or to differently shaped deflectors that are spaced one from the other.

Each side of deflector-holding surface 11, which may be rounded such as convex, is provided with a protective peripheral surface 13 that is thicker than surface 11, primarily extending rearwardly therefrom, and conforms to its peripheral curvature. The two peripheral surfaces 13 coincide at the bottom of deflecting section 5 to define a V-shaped discontinuity 14. Each peripheral surface 13 is recessed to define a portion 2*a* adapted to couple with a corresponding portion of the disinfecting section.

Deflecting section 5 is also configured with an upper, substantially vertically oriented surface 4, e.g. convex, which protrudes forwardly from the two peripheral surfaces 13. Two opposed side surfaces 6 are substantially perpendicular to surface 4, and extend rearwardly therefrom. A thin rear portion 3, which may be convex, extends between the two side surfaces 6, and a reinforcing element 7 extends between the upper edge of surface 4 to portion 3, at approximately the centerline thereof, to define two openings 12 through which flushing water is introducible to the anti-splash device. Reinforcing element 7 may be concealed by a portion of the hanger. Portion 3 and the two side surfaces 6 are recessed to define a portion 2*b* adapted to couple with a corresponding portion of the disinfecting section.

Figure 3:
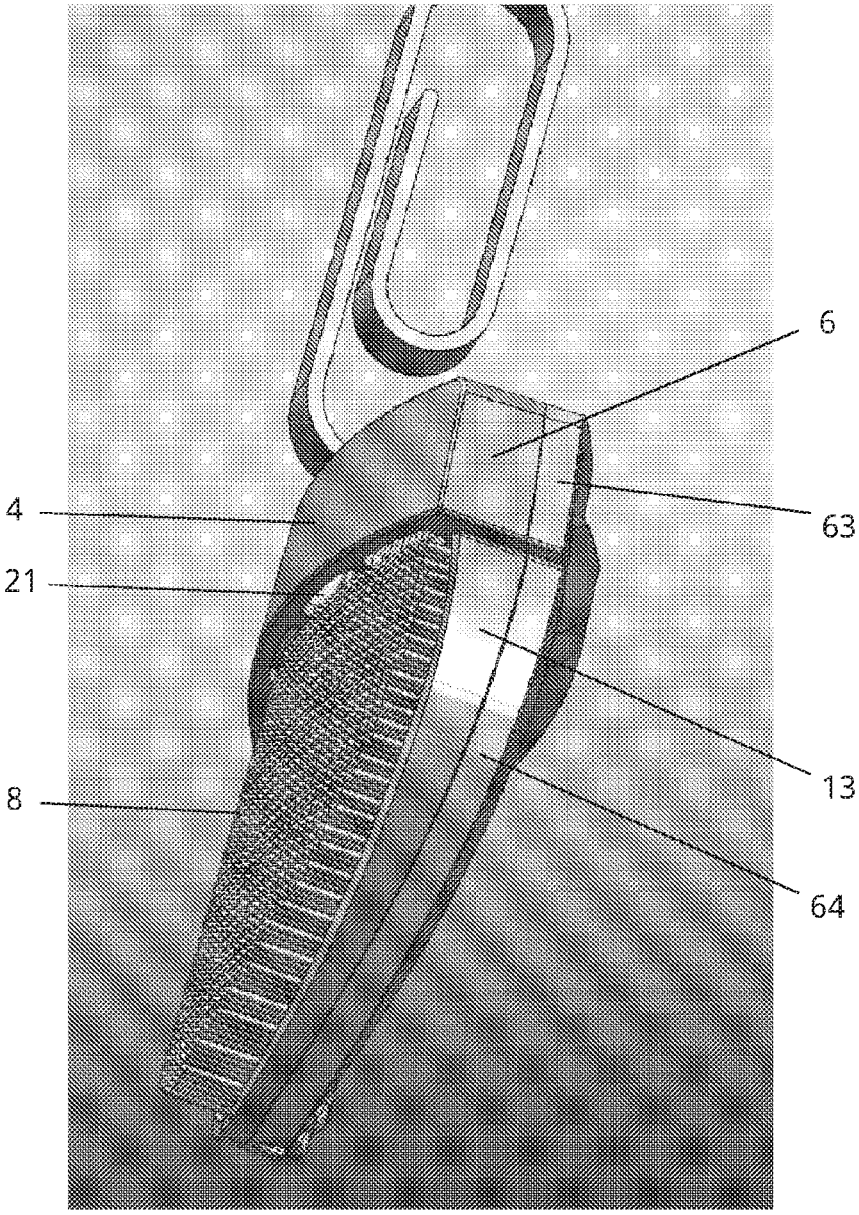
FIG. 3 is a perspective view from the side of the anti-splash device of FIG. 1.

As shown in FIG. 3, the positioning of surface 4 forwardly with respect to the two protective edges 13 defines one or more apertures 21 that overlie dispersing region 8. A disinfectant stream, after being generated as will be described below, flows through each aperture 21 and is accordingly directed to each deflector of dispersing region 8, which may be of a different length, to ensure a sufficient cleaning action.

Figure 4:
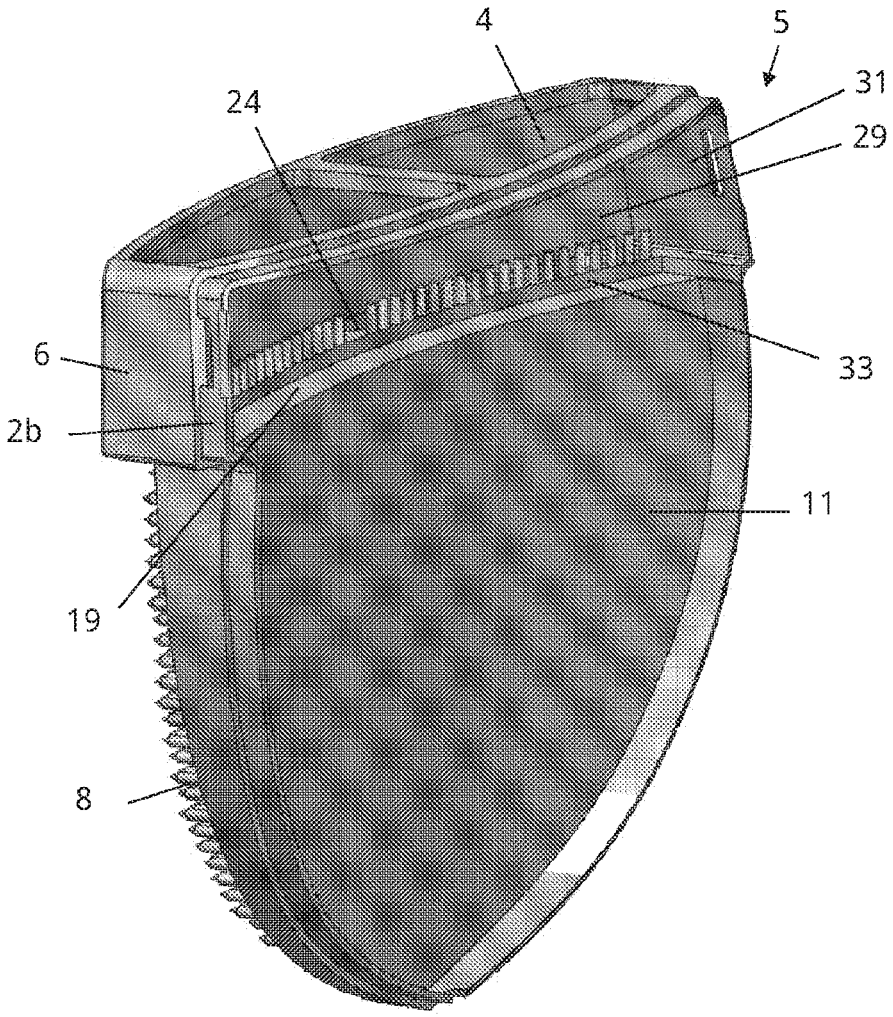
FIG. 4 is a perspective view from the rear of the deflecting section of FIG. 2, when separated from the disinfecting section.

With reference to FIG. 4, deflecting section 5 may also be configured with a flow restricting chamber 29 and with a plurality of spaced flow restriction elements 22 positioned with the flow restricting chamber 29. Flow restricting chamber 29 is defined by forward surface 4 and by each inner surface 31 which is common to a corresponding side surface 6 and coupling portion 2*b*. Forwardly to the upper surface 19 of deflector-holding surface 11 is formed a substantially horizontal restrictor-holding surface 24. A substantially vertical wall 33 extends upwardly from the forward edge of surface 19 to restrictor-holding surface 24. Restrictor-holding surface 24 extends between the two inner side surfaces 31, and also extends to forward surface 4. The plurality of flow restriction elements 22, each of which may be an elongated rod having a length of 3-10 mm and extending upwardly from restrictor-holding surface 24, are configured to restrict the flow of a disinfectant stream originating from the disinfecting section and to produce a pressure drop downstream to the flow restriction elements 22. Dispersing region 8 may be cleaned with an improved cleaning action when a disinfectant stream of reduced flow is able to be generated. A degree of flow restriction may be controlled by varying the density of flow restricting elements 22.

Figure 5:
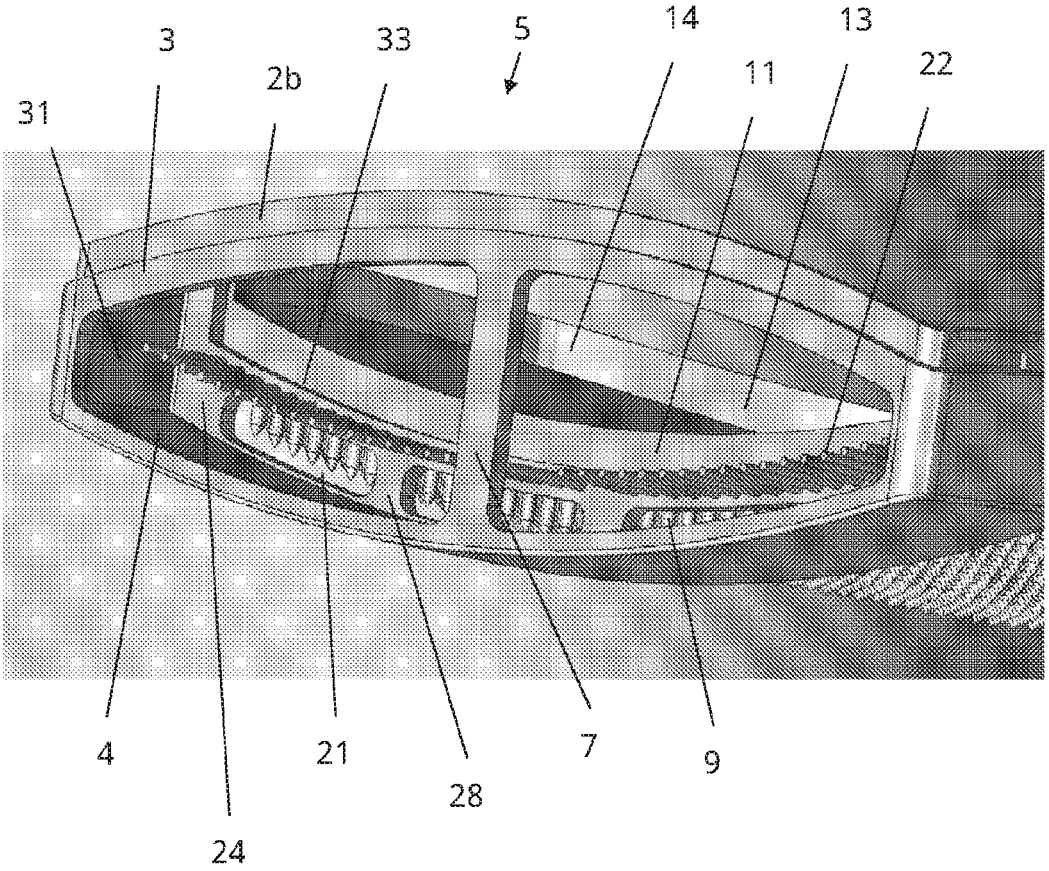
FIG. 5 is a perspective view from the top of the deflecting section of FIG. 2, when separated from the disinfecting section.

FIG. 5 illustrates deflecting section 5 from above. Restrictor-holding surface 24 is shown to be in abutment with the inner face of forward surface 4 and side surfaces 31 of the flow restricting chamber. Each of the apertures 21 formed within restrictor-holding surface 24 is defined by at least one diving portion 28 extending from vertical wall 33 to forward surface 4, and is shown to overlie a plurality of rods 9 extending forwardly from deflector-holding surface 11. Flow restriction elements 22 are shown to be positioned on restrictor-holding surface 24 rearwardly from each of the apertures 21. Reinforcing element 7 extending to rear portion 3, which is adjacent to coupling portion 2*b*, may be vertically aligned with lower discontinuity 14.

Figure 6:
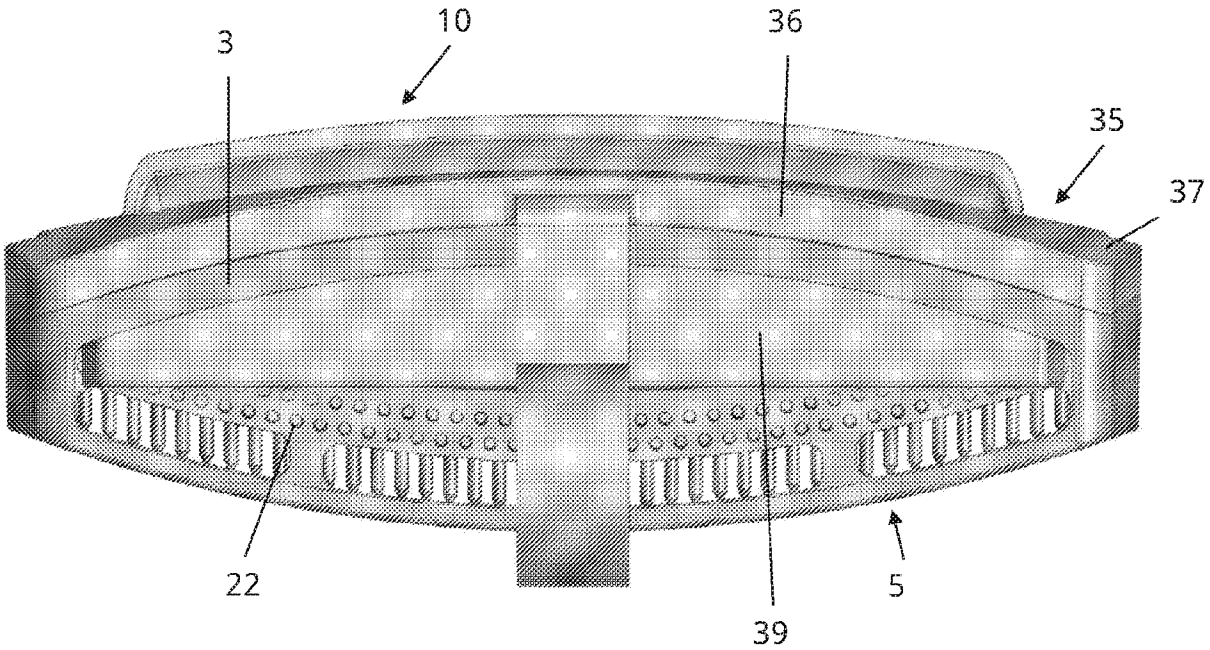
FIG. 6 is a perspective view from the top of the anti-splash device of FIG. 1.

FIG. 6 illustrates assembled anti-splash device 10 from above. When deflecting section 5 and disinfecting section 35 are coupled together, as shown, upper surface 36 of disinfecting section 35 is in abutting relation with, and positioned rearwardly with respect to, the entire convex rear portion 3 of deflecting section 5. A guiding surface 39 extending forwardly from rear surface 37 of disinfecting section 35, which may be planar, is located below rear portion 3 of deflecting section 5, and terminates rearwardly of flow restriction elements 22. When flushing water is introduced through the two openings 12 (FIG. 2) of deflecting section 5, the flushing water gravitates onto guiding surface 39 and is subsequently guided towards a solid hygienic product located therebelow to generate a disinfectant stream directed to the dispersing region. By virtue of the presence of guiding surface 39, the rate of dissolution of the solid hygienic product is minimized as it is not contacted directly by the flushing water, but rather only a portion of the flushing water introduced through openings 12 is guided towards the solid hygienic product. Optionally, surface 39 may be partially or completely removed, in order to increase the amount of water guided towards the solid hygienic product, as desired. In this case, the concentration of hygienic product 82 in the flushing water will be higher.

The solid hygienic product may be a solid block composition or a solidified gel composition that comprises one or more cleaning constituents, including, but not limited to, a surfactant constituting a cleaning agent, a foaming agent, a fragrance constituent, and a combination thereof.

FIGS. 7-13 illustrate another embodiment of the invention wherein disinfecting section 45 of anti-splash device 50 comprises two solid hygienic products, each of which retained in a separate retaining chamber. The first generates a disinfectant stream directed to the dispersing region of the deflecting section, as described above. The second solid hygienic product is used to generate a disinfectant stream that flows directly to the toilet bowl.

Figure 7:
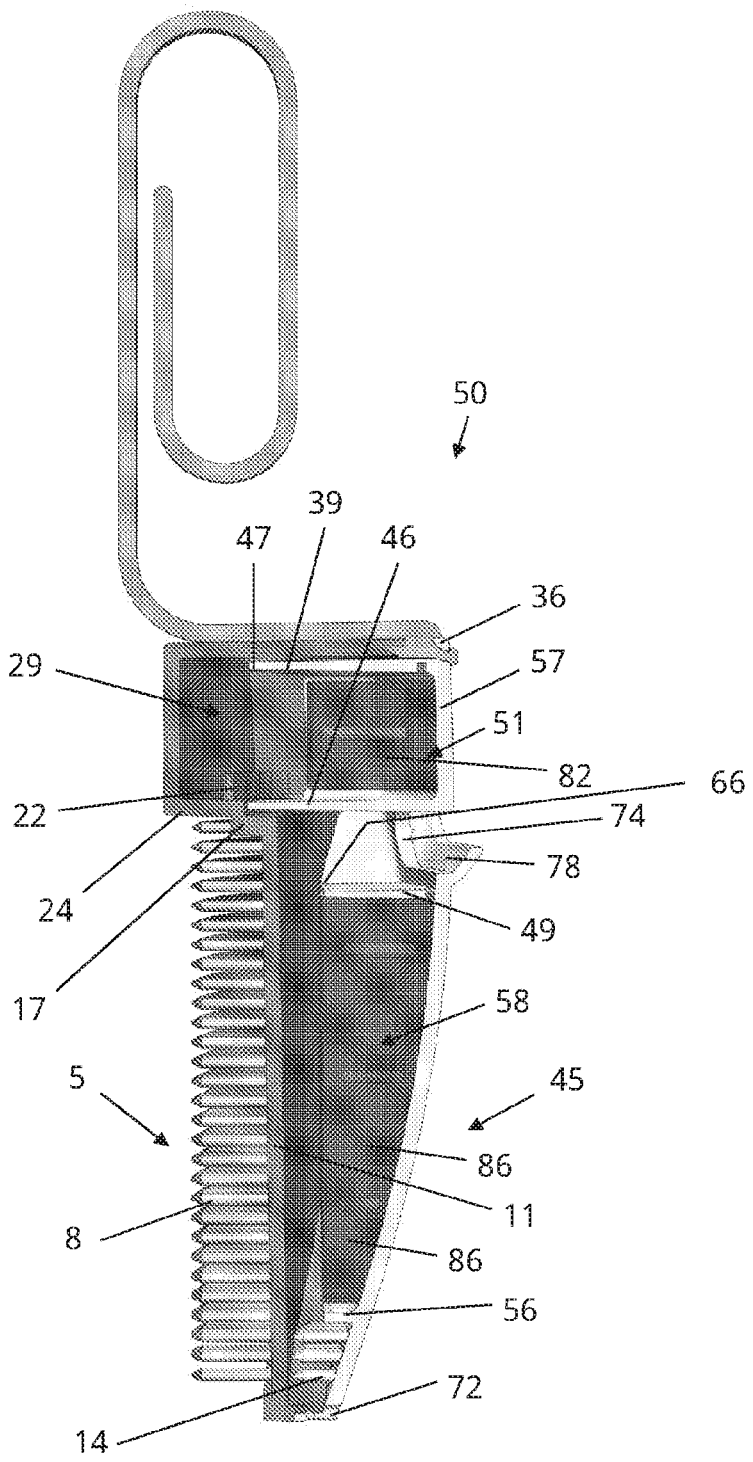
FIG. 7 is a perspective, vertical cross-sectional view of an anti-splash device according to another embodiment of the invention.
Figure 8:
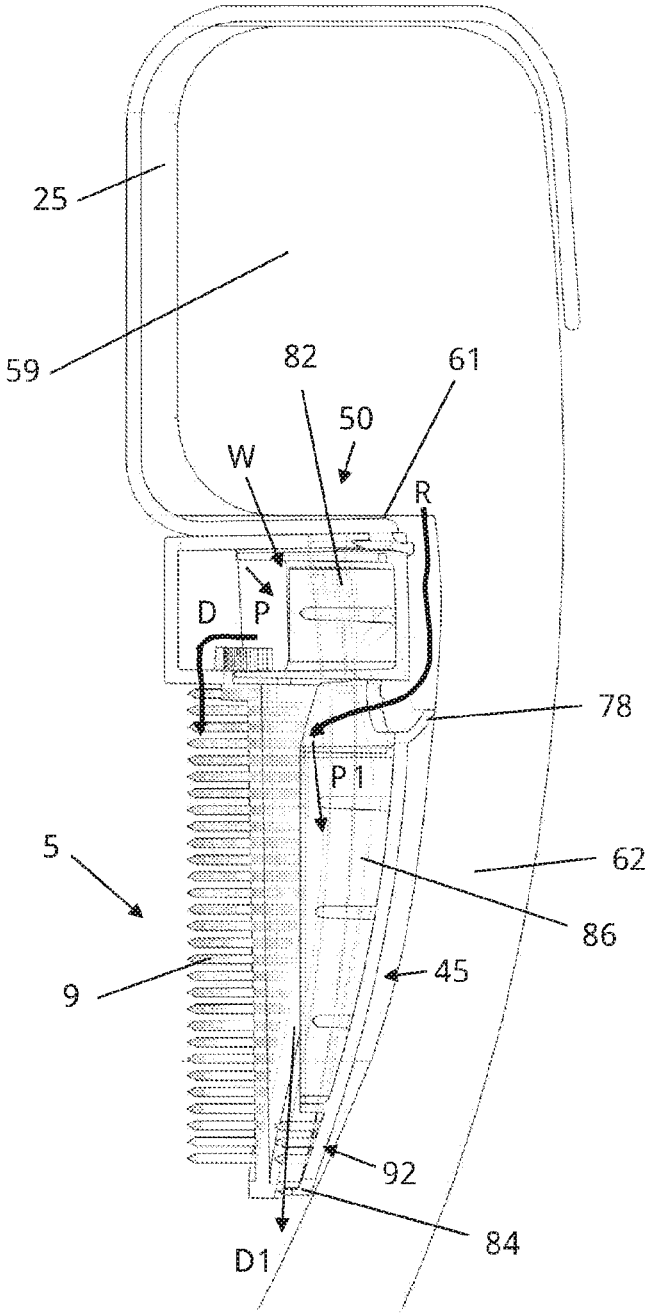
FIG. 8 is a perspective, vertical cross-sectional view of the anti-splash device of FIG. 7, shown when suspended from a toilet bowl rim.

FIG. 7 illustrates anti-splash device 50 in perspective, cross-sectional view, and FIG. 8 illustrates anti-splash device 50 in perspective, cross-sectional view when suspended by hanger 25 from toilet bowl rim 59.

Figure 9:
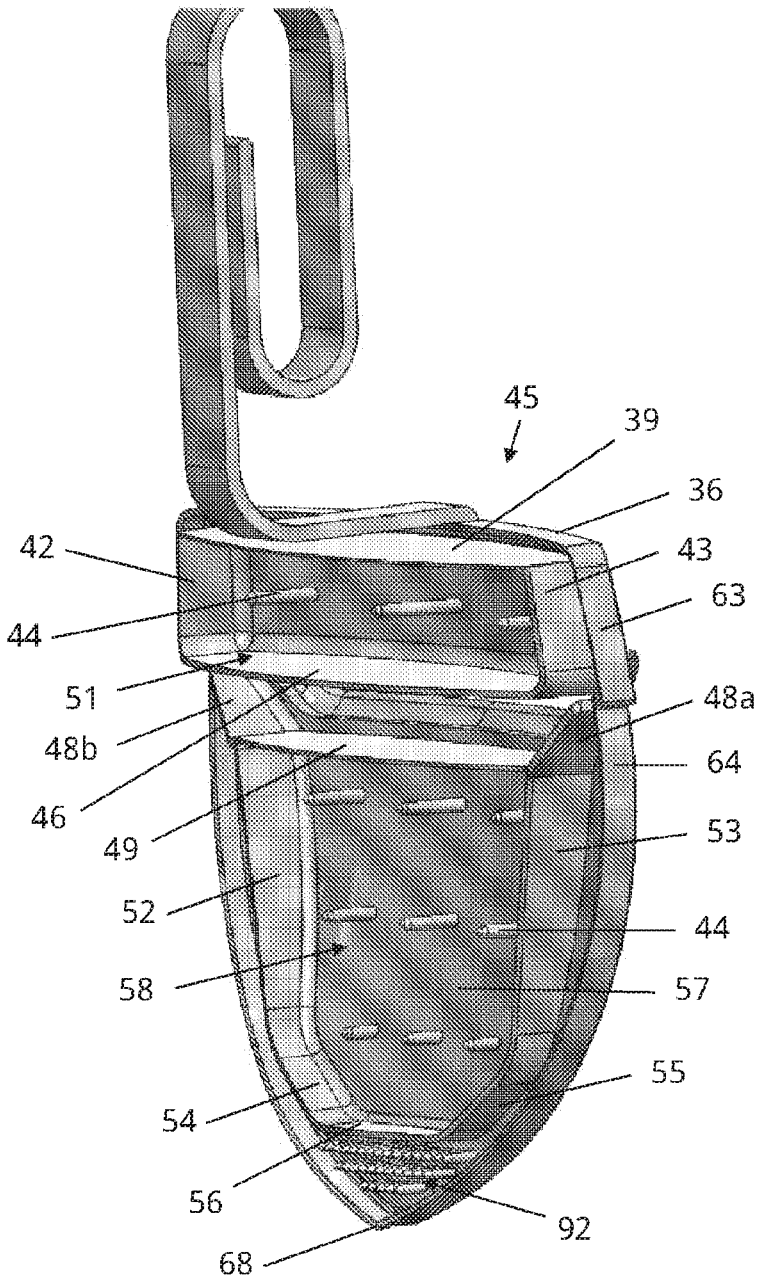
FIG. 9 is a perspective view from the front of a disinfecting section used in conjunction with the anti-splash device of FIG. 7, when separated from the deflecting section.
Figure 10:
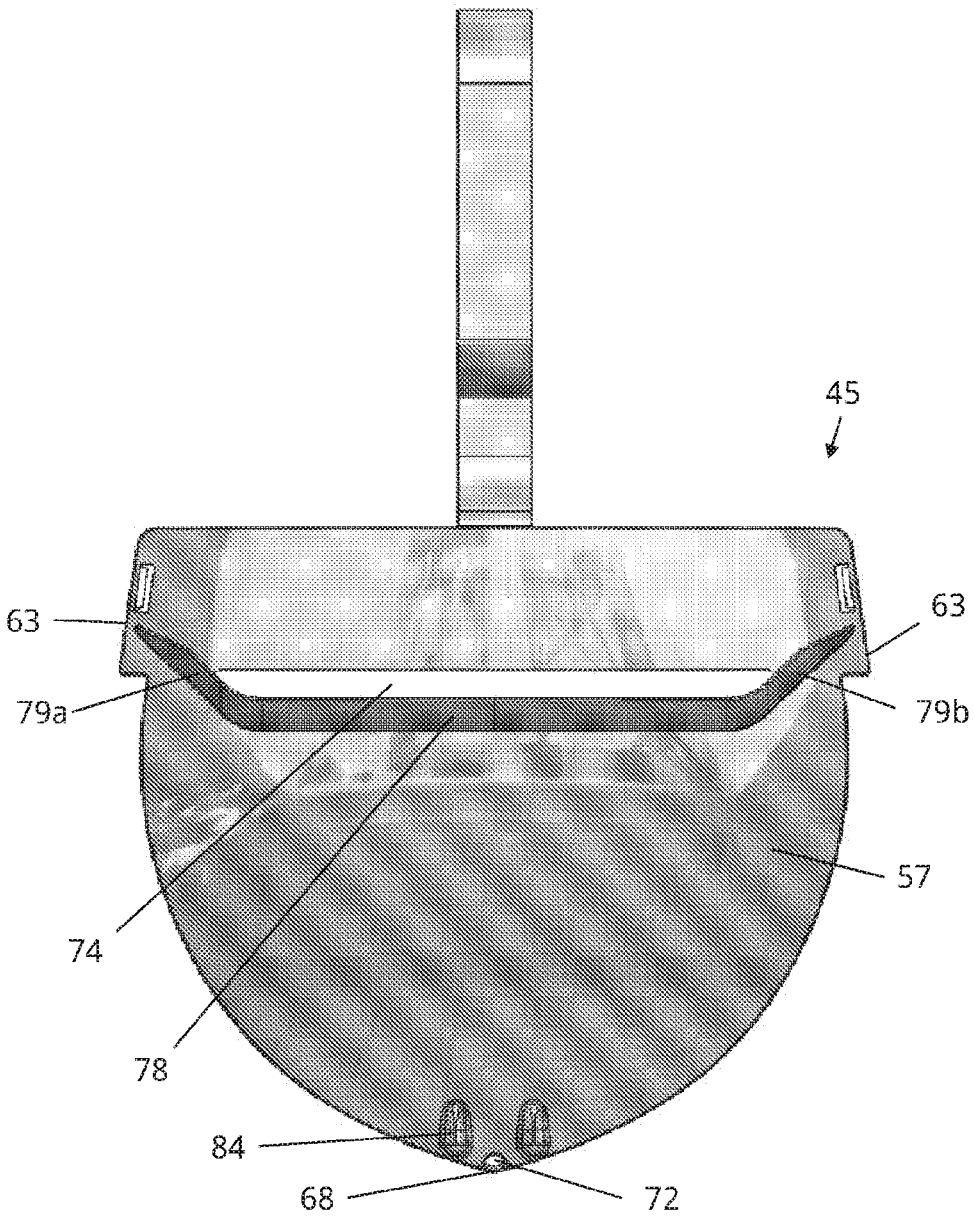
FIG. 10 is a rear view of the disinfecting section of FIG. 9.
Figure 11:
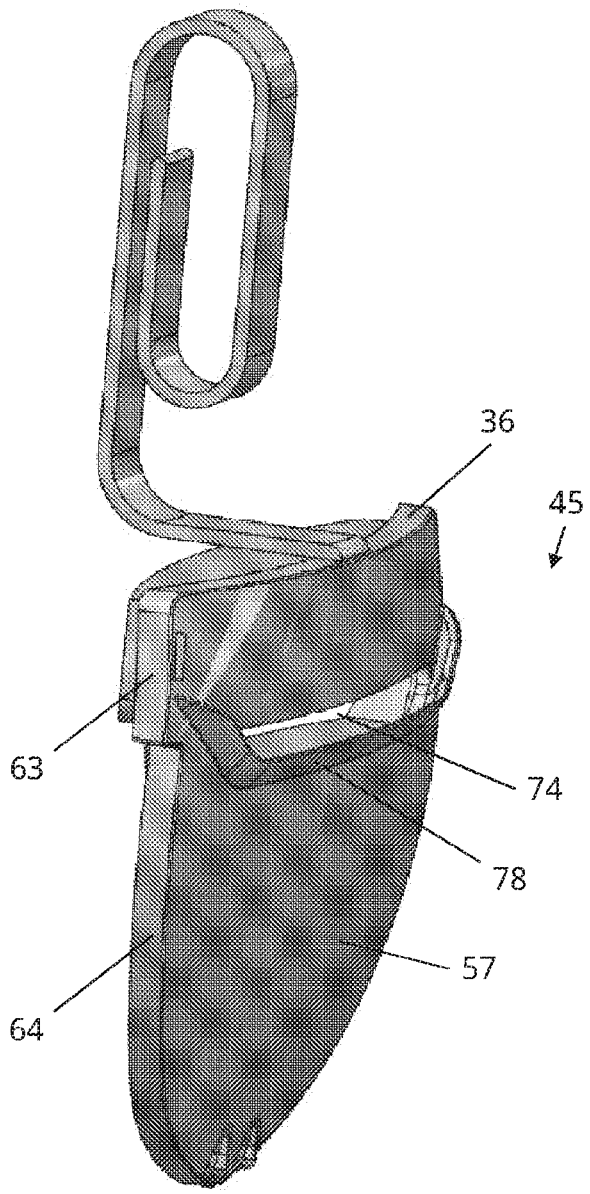
FIG. 11 is a perspective view from the top and rear of the disinfecting section of FIG. 9.

FIGS. 9-11 illustrate disinfecting section 45 when separated from the deflecting section. As shown, disinfecting section 45 comprises first retaining chamber 51 and second retaining chamber 58 located below first retaining chamber 51. The walls of retaining chambers 51 and 57 protrude forwardly from rear surface 57 of disinfecting section 45, which is configured similarly to the general shape and dimensions of the deflecting section. Disinfecting section 35 of FIG. 1 may be identical to disinfecting section 45, with the exception of the second retaining chamber.

First retaining chamber 51 is defined from above by guiding surface 39 located below upper surface 36 of disinfecting section 45, side surfaces 42 and 43, and bottom surface 46. Second retaining chamber 58 is defined from above by secondary guiding surface 49, which may be planar, side surfaces 52 and 53 substantially perpendicular to secondary guiding surface 49, bottom surface 56, and oblique surfaces 54 and 55 interfacing between bottom surface 56 and a corresponding side surface to accommodate the reducing width of rear surface 57.

Retaining chambers 51 and 58 are enclosed by protective peripheral surfaces 63 and 64, respectively, which protrude forwardly from rear surface 57 and conform to its peripheral shape. As further shown in FIG. 3, upper protective peripheral surface 63 is adapted to be flush with a corresponding side surface 6 of the flow restricting chamber of the deflecting section, and lower protective peripheral surface 64 of a narrower dimension than upper protective peripheral surface 63 is adapted to be flush with a corresponding protective peripheral surface 13 of the deflecting section, after receiving the corresponding coupling portion.

The two opposed and curved lower peripheral surfaces 64 coincide at the bottom of disinfecting section 45 to define a V-shaped discontinuity 68 coinciding with V-shaped discontinuity 14 of deflecting section 5 (FIG. 2). Rear surface 57 is formed with a small aperture 72 slightly above V-shaped discontinuity 68, through which the disinfectant stream generated by second retaining chamber 58 is discharged to the toilet bowl.

Rear surface 57 extends continuously from V-shaped discontinuity 68 to upper surface 36. An elongated opening 74, through which is introducible flushing water for use by second retaining chamber 58, is formed in a central region of rear surface 57, such that an upper edge of opening 74 coincides with, or is located below, bottom surface 46 of first retaining chamber 51.

Elongated abutment 78, adapted to contact the toilet bowl rim when anti-splash device 50 is suspended therefrom, extends rearwardly from rear surface 57 and below opening 74. The bottom edge of abutment 78 is substantially parallel to upper surface 36 of disinfecting section 45. Abutment 78 is fixed obliquely to rear surface 57 while extending upwardly into the projected area of opening 74, to guide the residual flushing water that was not introduced into the first retaining chamber 51. Two terminal ends 79*a* and 79*b* extend at an angle from either side of abutment 78 along rear surface 57 to a region thereof that is proximate to a corresponding protective peripheral surface 63, while continuing to be at approximately the same angle relative to rear surface 57 as abutment 78. These terminal ends 79*a* and 79*b* guide the residual flushing water to aligned sloped walls 48*a* and 48*b*, respectively, extending from the upper edge of the corresponding side wall of second retaining chamber 58 towards the corresponding inner face interface between protective peripheral surfaces 63 and 64. The residual flushing water flows downwardly along sloped walls 48*a* and 48*b* towards secondary guiding surface 49.

Two, or any other number, of additional small-sized abutments 84 adapted to contact the inner surface of the toilet bowl may protrude rearwardly from rear surface 57 slightly above discharge aperture 72.

Figure 12:
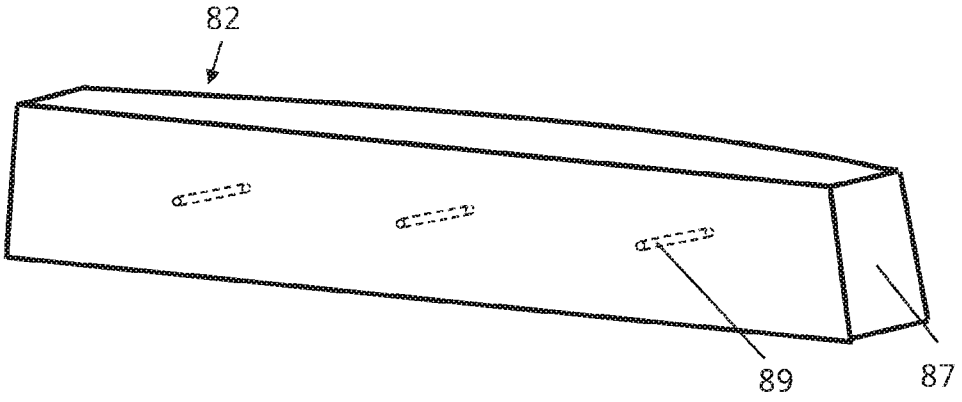
FIGS. 12 and 13 are a perspective view from the front of two solid hygienic products, respectively, used in conjunction with the disinfecting section of FIG. 9.
Figure 13:
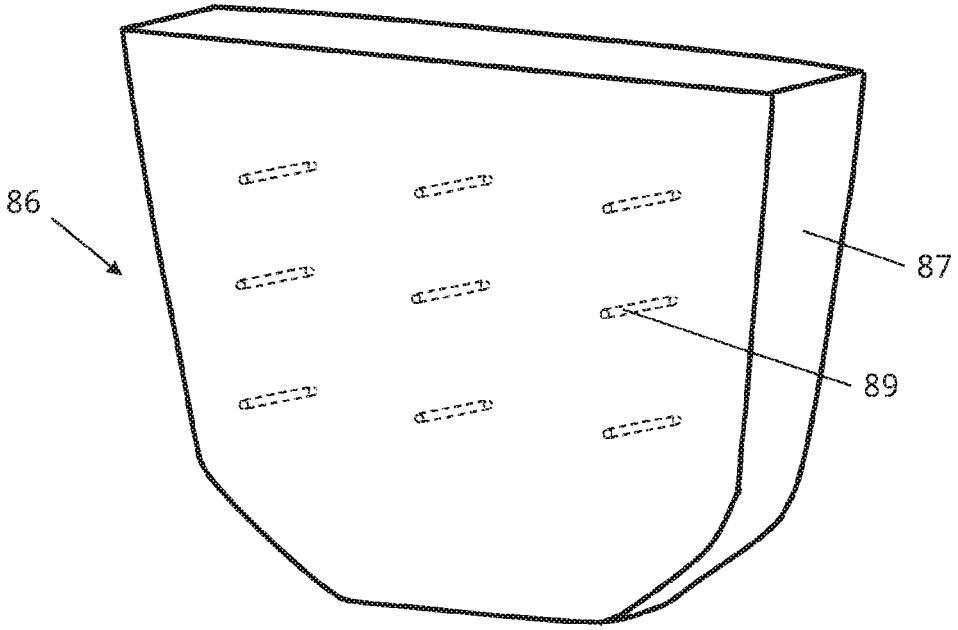

FIG. 12 illustrates a solid hygienic product 82 retainable by first retaining chamber 51, and FIG. 13 illustrates a solid hygienic product 86 retainable by second retaining chamber 58. Each of solid hygienic products 82 and 86 are formed with a plurality of spaced bores 89, each of which adapted to be received in a corresponding holding pin 44 (FIG. 9), or in any other retaining structure, protruding forwardly from rear surface 57 of disinfecting section 45. For example, hygienic product 82 is retained by three holding pins 44 and hygienic product 86 is retained by nine holding pins. The peripheral surfaces 87 of factory-fabricated hygienic products 82 and 86 are adapted to be in abutting relation with the protruding walls of the corresponding retaining chamber. The original thickness of hygienic products 82 and 86 is substantially equal to the protruding dimension of each wall of the corresponding retaining chamber.

With reference back to FIGS. 7 and 8, the generation of the disinfectant streams will now be described.

When deflecting section 5 and disinfecting section 45 are coupled together, bottom surface 46 of first retaining chamber 51 is substantially aligned with restrictor-holding surface 24 of flow restricting chamber 29 to provide a substantially continuous surface. An upper portion 17 of deflector-holding surface 11 may be angled, beveled or otherwise conditioned to accommodate positioning of the forward end of bottom surface 46 needed for achieving such alignment.

Following a flushing operation, flushing water W fed from a water tank is discharged to rim underside 61 via a plurality of drain holes passing through rim 59 to induce a swirling action in toilet bowl 62. As flushing water W is discharged from a drain hole, it is introduced into upper openings 12 (FIG. 2) and gravitates onto guiding surface 39. Anti-splash device 50 may be hung onto such a peripheral region of rim 59 so that openings 12 will be aligned with a drain hole, or, alternatively, openings 12 intercept flushing water W flowing across underside 61.

In response to the impact of the turbulent flushing water W onto guiding surface 39, the flushing water W flows forwardly to terminal edge 47 of guiding surface 39 and at least a portion thereof P is guided to hygienic product 82 retained by retaining chamber 51. Terminal edge 47 may be rounded, or otherwise conditioned, to urge water portion P to flow in a rearward direction. When hygienic product 82 is of original dimensions, its forward edge is substantially aligned with terminal edge 47, and therefore hygienic product 82 is easily contacted by water portion P. By virtue of the conditioning of terminal edge 47, water portion P will also contact the forward edge of a partially dissolved hygienic product 82, whose rate of dissolution is reduced since it is not in direct contact with flushing water W.

A disinfectant stream D is produced following contact of the turbulent water portion P with hygienic product 82. Disinfectant stream D then flows forwardly across flow restricting elements 22 while its flow is caused to be reduced and possibly mixing with a portion of the flushing water W that was not directed to hygienic product 82. The disinfectant stream D is caused to gravitate onto the entire, or the majority of the, surface area of deflectors 9 of dispersing region 8, after passing through the apertures 21 (FIG. 5) of restrictor-holding surface 24, to provide a good cleaning action.

In addition, residual flushing water R flows downwardly across rear surface 57 of disinfecting section 45, and its additional passage is blocked by abutment 78, which is in contact with toilet bowl 62. Abutment 78 may be in alignment with another drain hole to receive the residual flushing water R, or, alternatively, the residual flushing water R is that water flowing across upper surface 36 of disinfecting section 45 that was not admitted to upper openings 12.

The blocked residual flushing water R is guided by abutment 78 to hygienic product 86 retained by retaining chamber 58, after passing through rear opening 74 and flowing forwardly across guiding surface 49 to terminal edge 66 thereof. Terminal edge 66 may be rounded, or otherwise conditioned, to urge water portion P1 to flow in a rearward direction. When hygienic product 86 is of original dimensions, its forward edge is substantially aligned with terminal edge 66, and therefore hygienic product 86 is easily contacted by water portion P1. By virtue of the conditioning of terminal edge 66, water portion P1 will also contact the forward edge of a partially dissolved hygienic product 86, whose rate of dissolution is also reduced since it is not in direct contact with flushing water W. A disinfectant stream D1 is produced following contact of the turbulent water portion P1 with hygienic product 86. Disinfectant stream D1 is then discharged into the interior of toilet bowl 62 via aperture 72.

Optionally, secondary guiding surface 49 may be partially or completely removed, in order to increase the amount of water guided towards the solid hygienic product 86, as desired. In this case, the concentration of hygienic product 86 in the flushing water will be higher.

Anti-splash device 50 may also be configured to obviate the tendency of the discharge aperture of prior art in-bowl dissolvable hygienic products of becoming obstructed. Since the relatively fast flowing disinfectant stream generated by a prior art dissolvable hygienic product passes through a small discharge aperture, the flow rate of the generated disinfectant stream upstream to the discharge aperture is greater than the flow rate of the disinfectant stream that is able to flow downstream to the discharge aperture. Due to the increased dwelling time of the disinfectant liquid, the discharge aperture thus functions as a filter that causes a pasty material to develop from the disinfectant liquid and to obstruct the discharge aperture.

In one embodiment, as shown in FIGS. 7-9, disinfecting section 45 of anti-splash device 50 is configured with a flow restricting region 92 positioned on rear surface 57 of disinfecting section 45 between bottom surface 56 of second retaining chamber 58 and discharge aperture 72. Flow restricting region 92 comprises a plurality of spaced flow restriction elements 94, shown to be arranged in three rows, but which can be arranged in any other suitable flow restricting fashion as well. Each flow restriction elements 94 may be an elongated rod that protrudes forwardly from bottom surface 56 of second retaining chamber 58. By providing a selected density of flow restriction elements 94, a corresponding pressure drop downstream to the flow restriction elements 94 may be achieved to restrict the flow of disinfectant stream D1 in desired fashion. As the flow rate of disinfectant stream D1 is reduced downstream to flow restricting region 92, disinfectant stream D1 is able to retain its liquid composition and discharge aperture 72 is able to remain unobstructed.

Anti-splash device 50 is sufficiently spacious to accommodate a large-sized hygienic product 86 by virtue of the concave rear face of deflector-holding surface 11 and the opposing convex rear face of the rear surface 57 of disinfecting section 45.

Figure 14:
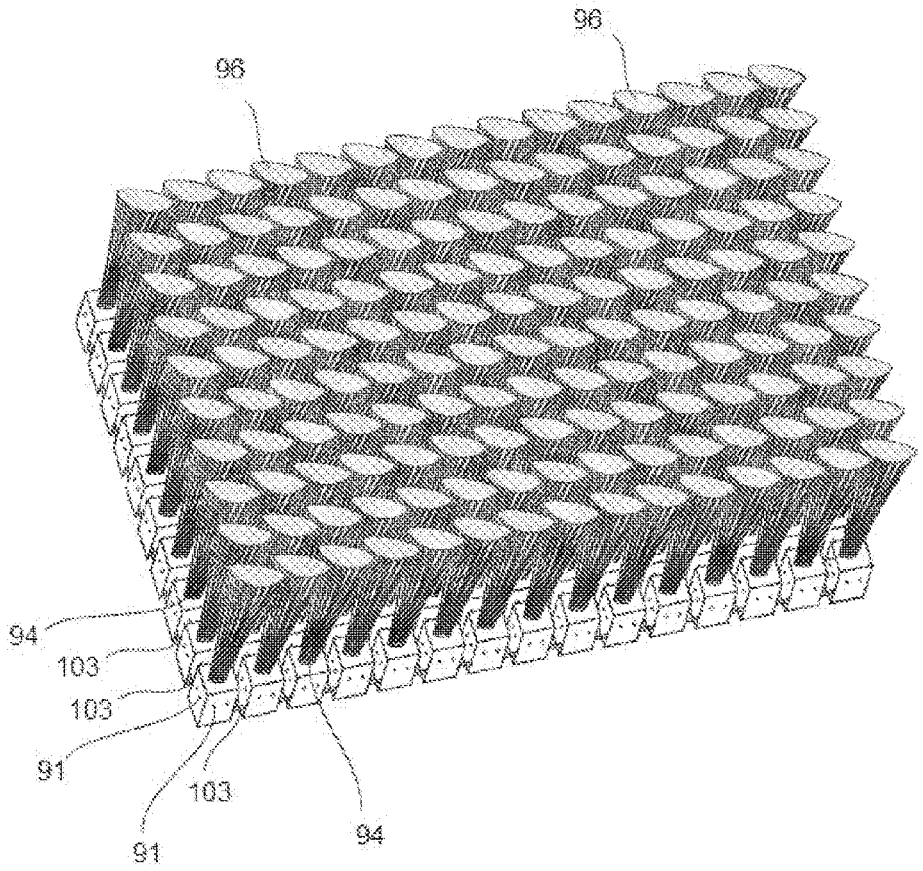
FIG. 14 shows a possible implementation of a surface for deflecting the urine flow.

FIG. 14 shows a possible implementation of a surface for deflecting the urine flow. The surface 93 consists of several rows of containers 94, which may be connected by connecting members 103. The surface 93 includes bristles 96 for absorbing the momentum of the urine flow in order to prevent splashing. These bristles 96 may be made of polymeric materials and may be attached to the surface 93 or to the containers 94. The length and density of bristles 96 may be adapted to obtain the desired absorbtion. Each container 94 may be a confined cavity with several openings 91 for allowing flushing water to penetrate into the container 94 and mix with a certain amount of hygienic product.

While some embodiments of the invention have been described by way of illustration, it will be apparent that the invention can be carried out with many modifications, variations and adaptations, (such as using a mesh, Velcro or sponge sheets surfaces for deflecting the urine flow) and with the use of numerous equivalents or alternative solutions that are within the scope of persons skilled in the art, without exceeding the scope of the claims.

The invention claimed is:

1. A toilet anti-splash device, comprising:

a) a rearwardly positioned section comprising a retaining chamber for retaining therewithin a solid hygienic product by which a disinfectant stream is generated upon being contacted by flushing water in response to a toilet-based water flushing operation;

b) a forwardly positioned section coupled with said rearwardly positioned section which comprises— i) a dispersing region configured with a deflector-holding surface, a plurality of spaced deflectors protruding from said deflector-holding surface for dispersing and deflecting urine flow, and a peripheral surface provided at each side of said deflector-holding surface; and ii) an upper chamber in fluid communication with said retaining chamber of said rearwardly positioned section and located above said dispersing region and defined by an upper surface which protrudes forwardly from, and between, each of said peripheral surfaces, said upper chamber having an upper opening through which flushing water is introducible and at least one lower opening located forwardly to each of said peripheral surfaces and rearwardly to said upper surface to overlie said plurality of deflectors, through said at least one lower opening the generated disinfectant stream is discharged and directed to all of said plurality of deflectors;

c) a hanger by which said anti-splash device is suspended from a toilet rim into an interior of a toilet bowl.

2. The anti-splash device according to claim 1, wherein each of the at least one lower opening smaller is smaller than the upper opening.

3. The anti-splash device according to claim 1, wherein the plurality of deflectors are configured by a plurality of vertically and laterally spaced rods protruding forwardly from the deflector-holding surface which is substantially vertically oriented.

4. The anti-splash device according to claim 1, wherein an upper surface of the rearwardly positioned section is positioned rearwardly with respect to, and in abutting relation with, an entire rear portion of the forwardly positioned section delimiting the upper opening.

5. The anti-splash device according to claim 1, wherein the retaining chamber of the rearwardly positioned section has an upper guiding surface extending forwardly from a rear, substantially vertically oriented surface of the rearwardly positioned section to an intermediate region of the upper opening and which is located below the upper surface of the rearwardly positioned section, said upper guiding surface adapted to guide at least a portion of the flushing water introduced through the upper opening towards the solid hygienic product.

6. The anti-splash device according to claim 1, wherein the upper chamber of the forwardly positioned section is provided with a substantially horizontal restrictor-holding surface located forwardly to an upper surface of the deflector-holding surface, a plurality of flow restriction elements extending upwardly from said restrictor-holding surface are configured to restrict flow of the generated disinfectant stream and to thereby ensure that the plurality of deflectors will be cleaned with an improved cleaning action.

7. The anti-splash device according to claim 6, wherein the restrictor-holding surface is formed with the at least one lower opening and the plurality of flow restriction elements are positioned on the restrictor-holding surface rearwardly from the at least one lower opening.

8. The anti-splash device according to claim 1, wherein the rearwardly positioned section further comprises an additional retaining chamber for retaining therewithin an additional solid hygienic product for generating an additional disinfectant stream flowing directly to the interior of the toilet bowl via a discharge aperture formed in a rear surface of the rearwardly positioned section.

9. The anti-splash device according to claim 8, wherein a rear face of the deflector-holding surface of the forwardly positioned section is concave and a rear face of the rear surface of the rearwardly positioned section is convex to accommodate positioning of the additional solid hygienic product.

10. The anti-splash device according to claim 8, wherein an elongated rear opening through which is introducible residual flushing water for use by the additional retaining chamber is formed in a central region of the rear surface of the rearwardly positioned section, such that an upper edge of said rear opening coincides with, or is located below, a bottom surface of the retaining chamber in fluid communication with the upper chamber of the forwardly positioned section.

11. The anti-splash device according to claim 10, further comprising an elongated abutment adapted to contact the toilet bowl extending rearwardly from the rear surface and below the rear opening, wherein said abutment is fixed obliquely to the rear surface and extends upwardly into a projected area of the rear opening, to guide the residual flushing water into the additional retaining chamber.

12. The anti-splash device according to claim 9, wherein the rearwardly positioned section further comprises a flow restricting region positioned on the rear surface below the additional retaining chamber, said flow restricting region adapted to restrict flow of the additional disinfectant stream from the additional retaining chamber to the discharge aperture and to thereby prevent blockage of the discharge aperture.

13. The anti-splash device according to claim 5, wherein a terminal edge of the upper guiding surface is conditioned to urge the at least a portion of the flushing water rearwardly towards the retaining chamber and to facilitate contact with a forward edge of the hygienic product.

14. The anti-splash device according to claim 3, wherein the plurality of rods are evenly vertically and laterally spaced.

15. The anti-splash device according to claim 3, wherein the plurality of rods are mutually parallel.

* * * * *